US008682022B2

(12) United States Patent
Cobb

(10) Patent No.: US 8,682,022 B2
(45) Date of Patent: Mar. 25, 2014

(54) LOUDSPEAKER

(76) Inventor: Jason Myles Cobb, Odessa, TX (US)

( * ) Notice: Subject to any disclaimer, the term of this patent is extended or adjusted under 35 U.S.C. 154(b) by 590 days.

(21) Appl. No.: 12/289,290

(22) Filed: Oct. 24, 2008

(65) Prior Publication Data

US 2010/0104127 A1 Apr. 29, 2010

(51) Int. Cl.
*H04R 1/00* (2006.01)
*H04R 9/06* (2006.01)
*H04R 11/02* (2006.01)

(52) U.S. Cl.
USPC ..... 381/404; 381/412

(58) Field of Classification Search
USPC ..... 381/396, 398, 401, 403, 404, 412, 420
See application file for complete search history.

(56) References Cited

U.S. PATENT DOCUMENTS

| | | | | |
|---|---|---|---|---|
| 3,112,375 | A | 11/1963 | Montagu | |
| 6,222,931 | B1 | 4/2001 | Cesati | |
| 6,526,151 | B1 | 2/2003 | Peng | |
| 6,735,322 | B1 * | 5/2004 | Watanabe | 381/401 |
| 6,819,773 | B2 | 11/2004 | D'Hoogh | |
| 7,149,323 | B2 * | 12/2006 | Yamagishi | 381/415 |
| 2004/0125980 | A1 * | 7/2004 | Turnmire et al. | 381/412 |
| 2007/0003100 | A1 * | 1/2007 | Liu | 381/412 |
| 2009/0060254 | A1 * | 3/2009 | Sano et al. | 381/412 |

FOREIGN PATENT DOCUMENTS

WO 9732451 4/1997

* cited by examiner

*Primary Examiner* — Walter L Lindsay, Jr.
(74) *Attorney, Agent, or Firm* — Sarah Hegi Simpson; McWhorter, Cobb & Johnson, LLP

(57) ABSTRACT

A loudspeaker including a bottom plate being formed from a material capable of transmitting a magnetic flux. The bottom plate has a bottom portion, a cylindrical inside portion that extends upwardly from the bottom portion, and a cylindrical outside portion that extends upwardly from the bottom portion and encircles the inside portion. A cylindrical magnet is positioned on the bottom portion. A top plate is formed from a magnetic flux-transmissive material and extends outwardly from the top of the magnet. The top plate is laterally spaced away from the outside portion so as to form an air gap between the top plate and the outside portion. A diaphragm has a bobbin portion that is positioned within the air gap and is capable of free movement in the air gap. The suspension portion of the diaphragm is positioned at the center of the magnet. The sound-producing portion of the diaphragm is affixed to the top of the bobbin portion and is affixed to the top of the suspension portion. A resilient spider extends between the suspension portion of the diaphragm and the magnet. A voice coil is wound around the bobbin portion within the air gap.

2 Claims, 1 Drawing Sheet

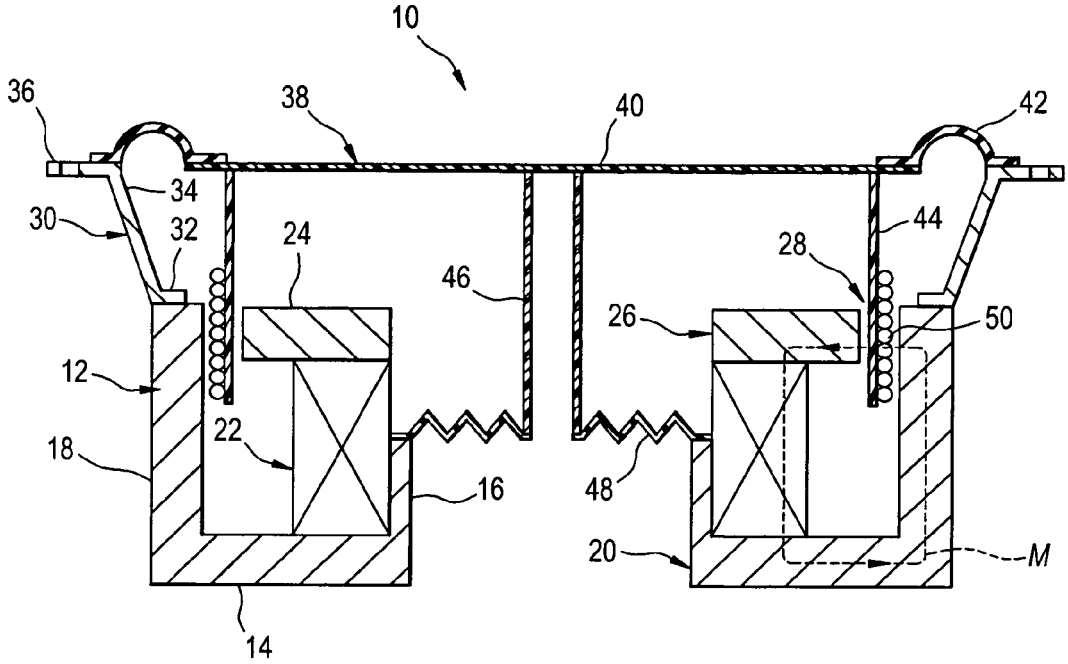
10
36
38
40
42
34
30
32
24
46
28
44
26
50
12
22
18
16
48
20
M
14

LOUDSPEAKER

SUMMARY OF THE INVENTION

My loudspeaker is an electrical audio signal processing device and, more particularly, an electro-acoustic audio transducer.

BRIEF DESCRIPTION OF THE DRAWING

The loudspeaker is best described with reference to the accompanying drawing that is a vertical, partial, cross-sectional view thereof. The loudspeaker is shown at 10 in the drawing.

DETAILED DESCRIPTION OF THE INVENTION

Loudspeaker 10 includes a bottom plate 12 that is formed from a material capable of transmitting a magnetic flux, like iron. Bottom plate 12 has a bottom portion 14 as well as an inside portion 16 and an outside portion 18 that are affixed to bottom portion 14. Bottom portion 14 is a ring having a central opening 20 therein. Inside portion 16 is a hollow cylinder that closely encircles opening 20 and extends upwardly from bottom portion 14. Outside portion 18 is, however, a hollow cylinder that extends upwardly from the outer periphery of bottom portion 14 and surrounds inside portion 16. Outside portion 18 is about twice as tall as inside portion 16.

A permanent magnet 22 is positioned upon bottom plate 12. Magnet 22 is a hollow cylinder having a central bore that is sized to snugly receive inside portion 16 therein. The bottom of magnet 22 is positioned upon bottom portion 14. Magnet 22 has an outer diameter that is less than the inner diameter of outside portion 18 and height that is greater than that of inside portion 16 yet less than that of outside portion 18. The bottom of magnet 22 engages bottom portion 14 so as to magnetically couple magnet 22 and bottom plate 12 whereby magnetic flux readily passes from one to the other.

A top plate 24 is affixed to the top of magnet 22. Top plate 24 is formed from a material that can transmit a magnetic flux, like iron. Top plate 24 is a ring having a central passageway 26 therein with a diameter that is the same as that of central bore 20. Top plate 24 has an outer diameter that is larger than that of magnet 22 and is smaller than the inner diameter of outside portion 18 thereby forming an air space or magnetic gap 28 between top plate 24 and outside portion 18. Air is free to circulate within magnetic gap 28 to cool magnet 22 during the use of loudspeaker 10.

A magnetic circuit is formed by bottom plate 12, magnet 22, and top plate 24 that generates magnetic flux M. The magnetic flux M passes from magnet 22 and into, and through, bottom portion 14 and outside portion 18. From outside portion 18 the magnetic flux M traverses magnetic gap 28 to reach top plate 24. Then, magnetic flux M extends from top plate 24 to return to magnet 22 thereby completing the circuit.

Loudspeaker 10 includes a frame 30 having an attachment ring or band 32 that extends around, and is affixed to, the top of outside portion 18 of bottom plate 12. A side wall 34 is affixed to, and extends upwardly and outwardly from, the periphery of attachment band 32. A mounting ring or flange 36 is affixed to, and extends outwardly from, the top of side wall 34.

A diaphragm 38 is affixed to frame 30. Diaphragm 38 has a sound-producing portion 40 that is a thin disk that is connected at its periphery by a resilient surround 42 to flange 36.

Diaphragm 38 also has a bobbin portion 44 that is affixed to the periphery of sound-producing portion 40. Bobbin portion 44 is a hollow cylinder that extends downwardly from the bottom of sound-producing portion 40 into magnetic gap 28 in such a manner that bobbin portion 44 can be freely moved up and down in magnetic gap 28. Diaphragm 38 further includes a suspension portion 46 that is affixed to the center of sound-producing portion 40. Suspension portion 46 is a hollow cylinder that extends downwardly from the bottom of sound-producing portion 40 through central passageway 26 to a location that is coplanar with the top of inside portion 16.

A corrugated spider 48 supports diaphragm 38. Spider 48 encircles the bottom of suspension portion 46 and extends outwardly therefrom to engage bottom plate 12. Spider 48 is connected to both suspension portion 46 and the top of inside portion 16.

A voice coil 50 encircles bobbin portion 44 and is positioned in magnetic gap 28 in such a manner that it will not impede the axial movement of bobbin portion 44. Magnetic flux M is applied to voice coil 50 by outside portion 18 and top plate 24. When an electrical current corresponding to an audio signal is applied to voice coil 50, voice coil 50 vibrates in a manner that causes diaphragm 38 to move cyclically up and down thereby generating sounds corresponding to the audio signal. Heat produced in the process of generating sounds is shed from loudspeaker 10 by the free movement of air around voice coil 50.

While loudspeaker 10 has been described with a high degree of particularity, it will be appreciated by those skilled in the field that modifications can be made to it. For example, while spider 48 is positioned within voice coil 50 to decrease mounting depth, spider 48 need not be affixed to inside portion 46, but, alternatively, can be affixed to magnet 22 or top plate 24. Thus, it is to be understood that the present invention is not limited merely to loudspeaker 10, but encompasses any and all loudspeakers within the scope of the following claims.

I claim:

1. A loudspeaker, comprising:

a bottom plate being formed from a material capable of transmitting a magnetic flux, said bottom plate including:

a bottom portion being a first ring having a central opening;

an inside portion having a first, hollow, cylindrical form; said inside portion being affixed to, and extending upwardly from, said bottom portion; and said inside portion encircling said central opening in said bottom portion; and, an outside portion having a second, hollow, cylindrical form; said outside portion being affixed to, and extending upwardly from, said bottom portion; and said outside portion encircling said inside portion;

a magnet having a third, hollow, cylindrical form; said magnet being affixed to, and extending upwardly from, said bottom portion between said inside portion and said outside portion; and said magnet being spaced away from said outside portion;

a top plate being a second ring formed from a material capable of transmitting a magnetic flux, said top plate being affixed to, and extending outwardly from, the top of said magnet; and said top plate being laterally spaced away from said outside portion so as to define an air gap between said top plate and said outside portion;

a diaphragm for producing audible sounds, said diaphragm including:

a bobbin portion being positioned within said air gap and being capable of free movement in said air gap;

a suspension portion being positioned at the center of said magnet; and, a sound-producing portion being affixed to the top of said bobbin portion and being affixed to the top of said suspension portion; and, a resilient spider connecting said suspension portion of said diaphragm to the top of said inside portion of said bottom plate; and, a voice coil being wound around, and being affixed to, said bobbin portion within said air gap.

2. A loudspeaker, comprising:

a bottom plate being formed from a material capable of transmitting a magnetic flux, said bottom plate including:

a bottom portion being a first ring having a central opening; and, an outside portion having a first, hollow, cylindrical form, and said outside portion being affixed to, and extending upwardly from, said bottom portion;

a magnet having a second, hollow, cylindrical form; said magnet being affixed to, and extending upwardly from, said bottom portion; and said magnet being spaced away from said outside portion;

a top plate being a second ring formed from a material capable of transmitting a magnetic flux, said top plate being affixed to, and extending outwardly from, the top of said magnet; and said top plate being laterally spaced away from said outside portion so as to define an air gap between said top plate and said outside portion;

a diaphragm for producing audible sounds, said diaphragm including:

a bobbin portion being positioned within said air gap and being capable of free movement in said air gap;

a suspension portion being positioned at the center of said magnet; and, a sound-producing portion being affixed to the top of said bobbin portion and being affixed to the top of said suspension portion; and, a resilient spider extending between said suspension portion and said magnet; and, a voice coil being wound around, and being affixed to, said bobbin portion within said air gap.

* * * * *